United States Patent [19]

Brown et al.

[11] Patent Number: 4,786,912

[45] Date of Patent: Nov. 22, 1988

[54] ANTENNA STABILIZATION AND ENHANCEMENT BY ROTATION OF ANTENNA FEED

[75] Inventors: Ralph A. Brown, Bountiful; Lowell N. Shestag, Cottonwood, both of Utah

[73] Assignee: Unisys Corporation, Blue Bell, Pa.

[21] Appl. No.: 882,839

[22] Filed: Jul. 7, 1986

[51] Int. Cl.[4] ..... H01Q 3/00

[52] U.S. Cl. ..... 343/761; 343/757; 343/766; 343/781 CA

[58] Field of Search ..... 343/757, 758, 761, 766, 343/882, 786, 781 CA

[56] References Cited

U.S. PATENT DOCUMENTS

| | | | |
|---|---|---|---|
| 2,945,229 | 7/1960 | Klauser | 343/761 |
| 3,662,393 | 5/1972 | Cohn | 343/786 |
| 3,939,480 | 2/1976 | Lewis | 343/761 |
| 3,987,452 | 10/1976 | Godet | 343/757 |
| 4,197,548 | 4/1980 | Smith et al. | 343/757 |
| 4,312,002 | 1/1982 | Stewart | 343/761 |
| 4,644,365 | 2/1987 | Horning | 343/882 |

*Primary Examiner*—William L. Sikes
*Assistant Examiner*—Doris J. Johnson
*Attorney, Agent, or Firm*—G. Donald Weber, Jr.; Glenn W. Bowen

[57] ABSTRACT

An antenna system wherein the feed assembly is rotated to provide spatial polarization stabilization with respect to vehicle movement so that orthogonal polarizations can be used simultaneously.

8 Claims, 1 Drawing Sheet

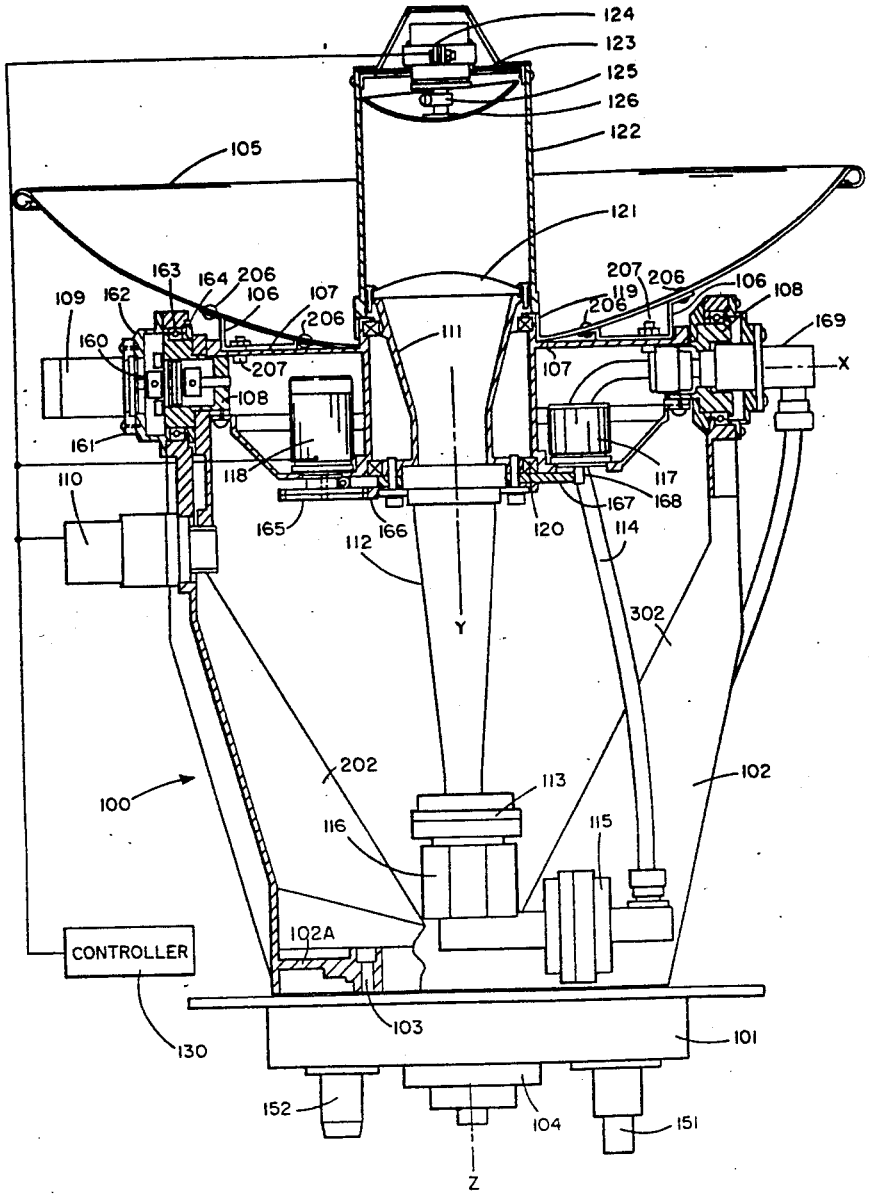
124
123
125
126
122
105
121
163
164
206
106
107
206
109
162
160
207
108
161
111
207
206
119
206
106
108
169
X
107
118
110
165
166
112
120
167
168
117
114
Y
302
202
113
102
100
116
115
CONTROLLER
102A
130
103
101
152
104
151
Z

ANTENNA STABILIZATION AND ENHANCEMENT BY ROTATION OF ANTENNA FEED

BACKGROUND

1. Field of the Invention

This invention is directed to microwave antennas, in general, and, more specifically, to antennas which are mounted on a movable platform (vehicle) the motion of which tends to cause the polarization and beam pointing to become disoriented with respect to a required transmission path. This invention achieves dynamic polarization and beam stabilization so that path alignment requirements can be met.

2. Prior Art

There are many antenna systems known in the art. These antenna systems can be used in radar systems or the like and can be used for tracking and/or signalling. Most of the known antenna systems operate on a rotating basis to provide both the azimuth and elevation variable. This two-axis antenna system is usually arranged to be supported on bearings and driven by a motor-gear-train apparatus. Thus, two degrees of rotation are achieved.

In the past, in order to compensate for variations in the operation of the antennas, circular polarization of the signal has been required. However, this signal configuration tends to cause significant problems in the generation of the signal, as in the well as interpretation of any response signals. However, in the past utilization of linearly polarized signals has been precluded inasmuch as an operational third degree of rotational freedom has been impractical. Typically, the circularly polarized signals which are currently used tend to be relatively easy to separate from noise and other background signals while, also, producing little or no problem in terms of reflection signals. These are advantages of using circular polarization, over linearly polarized signals. That is, with linear polarization, the signal produced by existing equipment produces variable response signals and, as well, produces stray signals and the like.

It has been recognized that in order to utilize linear polarization, it is necessary to provide a stabilized antenna. This requirement is usually dependent upon a stabilized antenna platform. With this apparatus, it is possible to keep the signals which are generated by the antenna at right angles (i.e., linear polarization) without having the problems noted above. Also, this would avoid the necessity for utilization of circular polarization signals.

On the other hand, stable platforms have been determined to be extremely complex and cumbersome in terms of being relatively large and heavy. This is a distinct drawback in many applications. As a consequence, use of linear polarization for dual channel isolation has been largely ignored in airborne systems, in general, and airborne antenna systems, in particular.

Many antenna systems utilize two-axis rotational motion. Typically, there are independent elevation and azimuth axes to permit complete spatial coverage from the horizon to near zenith at all azimuth angles—with allowance for pitch and roll movements of the vehicle. These two-axis antenna systems are usually arranged to be supported on bearings and driven by motor-gear-train apparatus. A servo system is included to realize positive control based on the required beam pointing information. Usually, there is no provision for a third axis of motion. Even if provision for a third axis is implemented, it is not dynamically controlled and is not referenced to a fixed spatial coordinate.

In the past, problems associated with polarization misalignment were reduced by the use of circular polarization. With circular polarization, there is no signal loss due to a relative tilt between two antennas as there is when linear polarization is used. Circular polarization also provides some relief from multipath effects at extremely small elevation angles. However, circular polarization is more difficult to implement than linear polarization.

In the present invention, the objective is to increase the use of a communication channel by using two orthogonal polarizations, simultaneously. Orthogonal signals do not couple together whereupon two independent signals can be transmitted on a single channel. The orthogonality can be realized by using either right- or left-hand circular polarization or dual linear polarization with each signal oriented in spatial quadrature (90 dgrees relative spatial position). Linear polarization is readily implemented without low tolerance requirements. However, for a variable attitude platform, linear polarization must be stabilized spatially. Circular polarization is very difficult to implement and requires very low tolerances.

SUMMARY OF THE INVENTION

This invention is directed to an antenna system wherein the antenna feed assembly of the antenna system is caused to rotate in accordance with control signals which can be related to the movement of the support system so as to produce the net effect of polarization stabilization without regard to a spatial coordinate system. Thus, with the other degrees of freedom in the movement of the antenna apparatus, a three-axis antenna with dual, orthogonal, linear polarization that is spatially stabilized is effectively produced.

In addition, by the expedient of providing a stepping sub-reflector in conjunction with the feed assembly, it is also possible to eliminate the gear trains and servo mechanisms required to maintain synchronization of the position of the sub-reflector with the antenna beam frequency.

BRIEF DESCRIPTION OF THE DRAWINGS

The sole FIGURE is a partially broken away, partially sectional representation of a radar antenna system in accordance with the instant invention.

DESCRIPTION OF A PREFERRED EMBODIMENT

Referring now to the sole FIGURE, there is shown a representation of a typical antenna system 100 which has been modified to include the improvements covered by the instant invention.

In particular, the antenna system 100 includes a suitable base 101 which is used to support the antenna apparatus. A yoke 102 comprising a substantially U-shaped arrangement has the bottom 102A thereof fastened to the base 101. A pair of upstanding arms 202 (shown partially broken away) and 302 of the yoke extend above the surface of the base 101. The yoke 102 includes appropriate forms and configurations so as to effect the appropriate strength factors. The yoke 102 can be mounted to the base 101 which is, typically, circular in configuration by means of suitable bolts 103 or other similar arrangement.

A rotary joint 104 is mounted at the base 101. The rotary joint 104, provides an RF input connection to the antenna apparatus from the external communication system (not shown). The rotary joint permits the connection despite the relative rotary motion of the base 101 and the rest of the antenna apparatus.

Suitable drive means 151 is arranged to drive the apparatus comprising the base 101 and the yoke 102 in a rotating fashion (i.e. through a full 360 degrees) around the Z axis of the rotary joint 104. Thus, the base 101 will operate in the nature of a turntable which can rotate at a prescribed speed and in a prescribed manner as determined by drive means 151 to allow the antenna beam to be steered to any desired azimuth direction. An azimuth position synchro 152 is associated with the azimuth RF input rotary joint 104 in order to provide the proper drive thereto. These components are conventional.

A typical reflector 105 is mounted adjacent the ends of the arms of yoke 102. In particular, the reflector 105 is mounted to the brackets 106 by means of suitable fasteners 206 such as rivets or the like. Likewise, the brackets 106 are fastened to a cross member 107 by means of suitable fasteners 207 such as rivets, nuts and bolts or the like. The cross member 107 is referred to, in this application, as an elevation strut. Thus, the elevation strut 107 serves to support the reflector 105.

The strut 107 is mounted at the upper ends of the arms of yoke 102 by means of rotary joints 108. The rotary joints 108 permit the elevation strut 107 to be selectively rotated about its axis, i.e. the X axis. When strut 107 rotates around its axis, it causes the reflector 105 to be moved in a "panning" motion while maintaining a suitable path for the RF signal which is supplied to feed 112 which is attached to strut 107 by the mountings noted infra. In a typical arrangement, this panning motion has a sweep of ±30 degrees, although suitable arrangements (not shown) of a rotary joint and gimbal mountings can accommodate even greater ranges. Thus, it is seen that the reflector 105 can pan over a wide elevation angle while, concurrently, operating in a circular (azimuth) movement at the same time.

Therefore, in the context of an airborne system, the apparatus 100 described thus far can produce compensation for the pitch, yaw and heading of an aircraft. However, the roll of the aircraft would remain uncompensated and a linearly polarized signal will tilt in accordance with movement of the aircraft. In this instance, the desirability for circular polarization, as noted in the Background section above, is apparent.

It is seen also, that the strut 107 is driven by the elevation motor drive 110 which is mounted on one of the upstanding arms of yoke 102. The elevation motor drive 110 is connected to drive strut 107 by means of a suitable gear train or the like.

In a similar fashion, the elevation synchro 109 is connected to strut 107 in order to permit the controller 130 for the antenna apparatus 100 to be able to determine the orientation of the elevation strut 107. The synchro 109 and the drive 110 are connected through the controller to properly position the reflector 105.

In a typical antenna system, the feed apparatus includes a horn 111 through which the RF signal is passed. The horn 111 is connected to the rotary joint 116 at the coupling flange 113. In a typical case (although not to be limitative of the invention described herein), the horn 111 is substantially circular in configuration while the feed supply 113 has a rectangular configuration. The feed transition 112 changes from a rectangular configuration to a circular configuration to provide a transition apparatus for transferring a signal from the input device to the horn.

In a typical case, the coupling flange 113 is connected to an RF signal feed line 114 which is flexible and passes through strut 107 as well as the mounting of the elevation rotary joint 108 at the upper end of yoke 102. The RF signal feed line 114 is connected to the RF signal source (not shown) through the azimuth rotary joint 104. In the example shown in the FIGURE, the feed line 114 is connected to a further signal coupler 115 which carries the RF signal to the feed assembly. In the embodiments shown and described herein, the signal couplers 115 and 113 are connected by means of a suitable rotary joint or coupler 116. This joint permits the feed assembly to rotate about the axis thereof, independently of the apparatus comprising the base 101 and the yoke 102.

In this embodiment, the horn 111, in combination with the sub-reflector 126, also serves the purpose of properly distributing the RF energy over the surface of the main reflector 105 in order to obtain proper beam shaping, for the energy beam which is generated by the system.

A drive motor 117 is mounted on a suitable bracket which can be associated with the elevation (or reflector support) strut 107. The drive motor 117 is connected to rotate the feed assembly which includes, inter alia, horn 111, transition 112 and the associated signal conducting components.

In a similar fashion,, a synchro pick-off 118 is also mounted on a suitable bracket which can be associated with the strut 107. The synchro 118 is used as a pick-off to determine the orientation of the feed assembly.

It is seen that the feed assembly, including horn 111, is mounted within the strut 107 by means of suitable ball bearing races 119 and 120. Thus, the horn 111 can rotate within, and relative to, strut 107.

Therefore, it can be seen that the feed apparatus can rotate about the vertical axis of the base 101, it can rotate about the horizontal axis of the elevation strut 107 and it can rotate about the central axis of the antenna and feed assembly comprising horn 111, transition 112, sub-reflector 126, reflector 105, and so forth. Therefore, three-axis rotation is provided.

In the embodiment shown in the FIGURE, a lens 121 is provided. In an optional arrangement, this electromagnetic lens may be used to provide an increase in gain. However, it should be understood that such a lens 121 is not deemed to be an essential ingredient or component of the apparatus of this invention.

Also shown connected to the horn 11 and, essentially, a continuation of the cylindrical horn end, is a sub-reflector support 122. In a typical case, the support 122 is fabricated of fiberglass or some other lightweight, RF signal transport material. Because it is connected to the feed assembly at horn 111, the support 122 moves and rotates therewith.

In the embodiment shown in the FIGURE, a suitable mounting bracket 123 is disposed over the open end of support 122. Mounted on the bracket 123 is a stepper motor 124. The stepper motor 124 has the shaft thereof connected through suitable coupling means 125 to the sub-reflector 126. The sub-reflector 126 can be fabricated in any standard fashion and includes a reflective surface. It is noted that the sub-reflector 126 is mounted slightly skewed relative to a stepper motor 124. Consequently, when motor 124 is operated and the shaft thereof rotates, sub-reflector 126 also rotates but in a somewhat eccentric or wobble-type path. This results in conically scanning the electromagnetic beam and is used for tracking. This is an optional feature of the apparatus and is also not essential to the invention as described herein.

Thus, a signal can be directed through the feed assembly in a normal fashion toward the reflective surface of sub-reflector 126 from whence it is reflected against the reflective surface of reflector 105 and, thence, outwardly in the targeted direction.

Thus, there is shown and described a unique antenna apparatus which has three degrees of axial freedom so that the pitch, roll and yaw of a support platform, (for example, an aircraft) can be compensated for by appropriate directions to the drives of the respective axes for the purpose of orienting the beam and polarization thereof. The signals can be supplied to the motors from a suitable controller 130, shown schematically. The controller 130 can include, inter alia, gyros which detect the maneuvers of the aircraft and convert the driving signals to the respective drive motors and the synchros. determine the position of the appropriate portions of the device.

Thus, there is shown and described a preferred embodiment of an antenna system which permits tracking of the signal and keeping the apparatus stabilized. Through the use of this type of apparatus, the antenna system can be arranged to use linear polarization rather than circular polarization. This allows the use of dual linear orthogonal polarization signals for the purpose of increasing the channel capacity.

The specific arrangement of components has been set forth. However, this specific arrangement is not intended to be limitative of the invention but, rather, is illustrative only. Those skilled in the art may conceive of modifications which fall within the purview of this description are intended to be included therein, as well. Consequently, the scope of the invention is limited only by the claims appended hereto.

We claim:

1. An antenna system comprising, support means (101, 102) comprising an open-ended yoke means mounted on a base wherein the support means is rotatable about an axis thereof extending vertically from said base and through said yoke means, first drive means (151) for selectively rotating said support means about said axis of said support means, reflector means (105) comprising a reflector dish for reflecting signals from a feed assembly pivotally mounted on said support means, second drive means (110) for selectively rotating said reflector means about an axis of said reflector means, feed assembly means (111, 112, 113) mounted in said support means adjacent to said reflector means, said feed assembly means including means for generating an RF signal and a horn for transmitting said RF signal, third drive means (117) for selectively rotating said feed assembly means about an axis of said feed assembly means, sub-reflector means mounted adjacent to and spaced from said reflector dish in a skewed fashion relative to said reflector dish, and stepper motor means arranged to drive said sub-reflector means in a rotary fashion about an axis of said sub-reflector means.

2. The antenna system recited in claim 1 wherein, said support means rotates about a first axis, said reflector means rotates about a second axis, and said feed assembly means rotates about a third axis, wherein said first, second and third axes are respective axes of said antenna system and, wherein each of said support means, said reflector means, and said feed assembly means can rotate about the respective axis independently of each other.

3. The antenna system recited in claim 1 including, electromagnetic lens means mounted adjacent to said feed assembly means to produce increased gain in the operation of said feed assembly mens.

4. The antenna system recited in claim 1 wherein, said first, second and third drive means each comprise motor drive means.

5. The antenna system recited in claim 1 including, first, second and third synchronizer means arranged to detect the position of said support means, said reflector means and said feed assembly means respectively.

6. The antenna system recited in claim 5 including, control means connected to each of said first, second and third drive means and to each of said first, second and third synchronizer means to determine the positions thereof and the related components of the antenna system.

7. The antenna system recited in claim 1 including, platform means on which said antenna system is mounted and arranged for three-degrees of motion.

8. An antenna system comprising, support means (101, 102), first drive means (151) for selectively rotating said support means about an axis of said support means whereby said support means rotates about a first axis, said support means includes a rotatable base and an upstanding, substantially U-shaped yoke extending above said base, said first axis of said support means passes axially through said rotatable base and between the arms of said U-shaped yoke, reflector means (105) pivotally mounted on said support means, said reflector means comprises a reflector dish for reflecting signals from said feed assembly, an elevation strut mounted in rotary joints adjacent the ends of the arms of said upstanding yoke, said elevation strut connected to support said reflector means along the axis about which said reflector means is selectively rotated, second drive means (110) for selectively rotating said reflector means about an axis of said reflector means whereby said reflector means rotates about a second axis, feed assembly means (111, 112, 113) mounted in said support means adjacent to said reflector means and operative to produce an RF signal to be reflected by said reflector means, a rotatable mounting means at said elevation strut for mounting said feed assembly means thereto, said feed assembly includes an RF signal feed means, signal coupler means connected to said RF signal feed means, and transition means connected between said signal coupler means and said RF signal feed means, third drive means (117) for selectively rotating said feed assembly means about an axis of said feed assembly means whereby said feed assembly means rotates about a third axis, said first, second and third axes are respective axes of said antenna system whereby each of said support means, said reflector means, and said feed assembly means can rotate about the respective axis independently of each other, first, second and third synchronizer means mounted in said antenna system and arranged to detect the position of said support means, said reflector means and said feed assembly means respectively, and control means connected to each of said first, second and third drive means and to each of said first, second and third synchronizer means in order to supply drive control signals to the respective drive means in response to operation of the respective synchronizer means.

* * * * *